US012274297B2

(12) United States Patent
Jang et al.

(10) Patent No.: US 12,274,297 B2
(45) Date of Patent: Apr. 15, 2025

(54) AEROSOL GENERATION DEVICE WITH REDUCED PREHEATING TIME

(71) Applicant: KT&G CORPORATION, Daejeon (KR)

(72) Inventors: Chul Ho Jang, Daejeon (KR); Gyoung Min Go, Daejeon (KR); Hyung Jin Bae, Daejeon (KR); Jang Won Seo, Daejeon (KR); Min Seok Jeong, Daejeon (KR); Jong Seong Jeong, Daejeon (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 603 days.

(21) Appl. No.: 17/429,769

(22) PCT Filed: Dec. 21, 2020

(86) PCT No.: PCT/KR2020/018746
§ 371 (c)(1),
(2) Date: Aug. 10, 2021

(87) PCT Pub. No.: WO2021/153908
PCT Pub. Date: Aug. 5, 2021

(65) Prior Publication Data

US 2022/0110368 A1 Apr. 14, 2022

(30) Foreign Application Priority Data

Jan. 31, 2020 (KR) ..... 10-2020-0011902

(51) Int. Cl.

| | |
|---|---|
| ***A24F 40/46*** | (2020.01) |
| ***A24D 1/20*** | (2020.01) |
| ***A24F 40/20*** | (2020.01) |
| ***A24F 40/57*** | (2020.01) |
| ***A24F 40/85*** | (2020.01) |

(52) U.S. Cl.
CPC ..... *A24F 40/46* (2020.01); *A24D 1/20* (2020.01); *A24F 40/20* (2020.01); *A24F 40/57* (2020.01); *A24F 40/85* (2020.01)

(58) Field of Classification Search
CPC ..... A24F 40/46; A24F 40/85; A24F 40/20; A24F 40/57; A24D 1/20
See application file for complete search history.

(56) References Cited

U.S. PATENT DOCUMENTS

| | | | | |
|---|---|---|---|---|
| 2016/0360794 | A1* | 12/2016 | Li | H05B 3/46 |
| 2017/0280777 | A1* | 10/2017 | Manca | H05B 3/265 |
| 2019/0297947 | A1 | 10/2019 | Bessant et al. | |
| 2019/0380390 | A1* | 12/2019 | Jeong | A24F 40/46 |
| 2020/0253279 | A1* | 8/2020 | Liu | A24F 40/05 |

FOREIGN PATENT DOCUMENTS

| | | | | |
|---|---|---|---|---|
| CN | 209134088 | U | 7/2019 | |
| KR | 10-2017-0094150 | A | 8/2017 | |
| KR | 10-2018-0070509 | A | 6/2018 | |
| KR | 10-2019-0009336 | A | 1/2019 | |
| KR | 10-2019-0045423 | A | 5/2019 | |
| KR | 10-2019-0049389 | A | 5/2019 | |
| KR | 10-1976663 | B2 | 5/2019 | |
| KR | 1976663 | B1 * | 5/2019 | A24F 47/008 |
| KR | 10-2019-0093027 | A | 8/2019 | |

OTHER PUBLICATIONS

KR-1976663-B1 English Machine Translation (Year: 2019).*
Communication dated Sep. 29, 2021 from the Korean Intellectual Property Office in Application No. 10-2020-0011902.
International Search Report for PCT/KR2020/018746, dated Jun. 28, 2021.
Extended European Search Report dated Mar. 24, 2022, issued in European Application No. 20875692.4.

* cited by examiner

*Primary Examiner* — Christopher M Rodd
*Assistant Examiner* — Adam Z Baratz
(74) *Attorney, Agent, or Firm* — Sughrue Mion, PLLC

(57) ABSTRACT

Provided herein is an aerosol generation device with a reduced preheating time. The aerosol generation device according to some embodiments of the present disclosure includes a case including an opening formed in one surface, and an article insertion portion into which an aerosol-generating article including an aerosol-generating substrate is inserted, an opening/closing type cover which is disposed on the one surface of the case to open and close the opening, and a heater configured to heat the inserted aerosol-generating article. Here, the opening/closing type cover is configured to, when closing the opening, mechanically press an aerosol-generating substrate portion of the inserted aerosol-generating article so that the entire aerosol-generating substrate portion is rapidly heated, and in this way, a preheating time of the device may be reduced.

6 Claims, 10 Drawing Sheets

[FIG. 1]
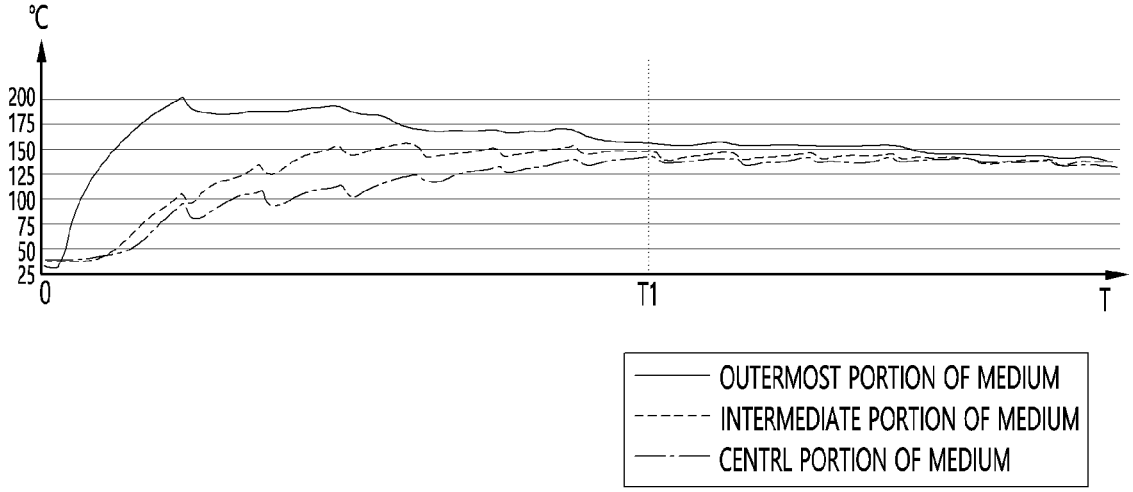

[FIG. 2]
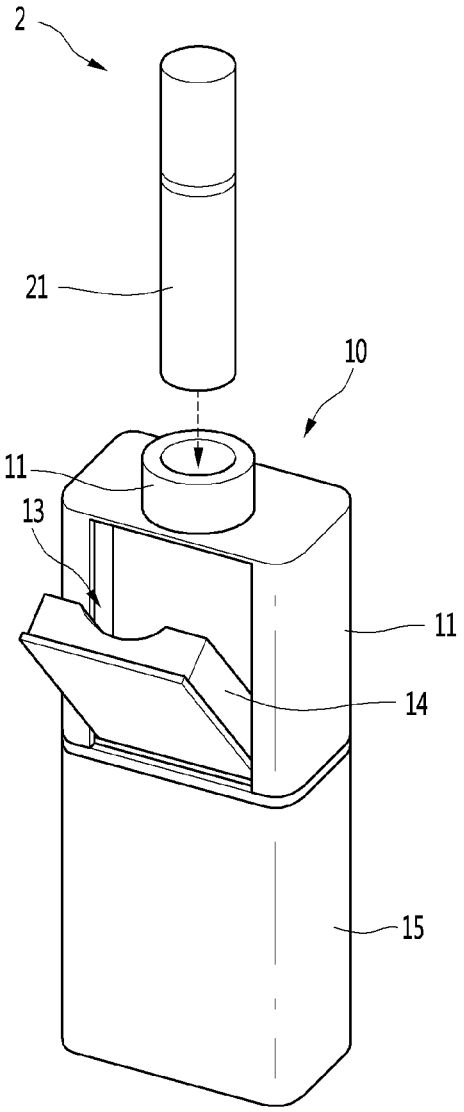

[FIG. 3]
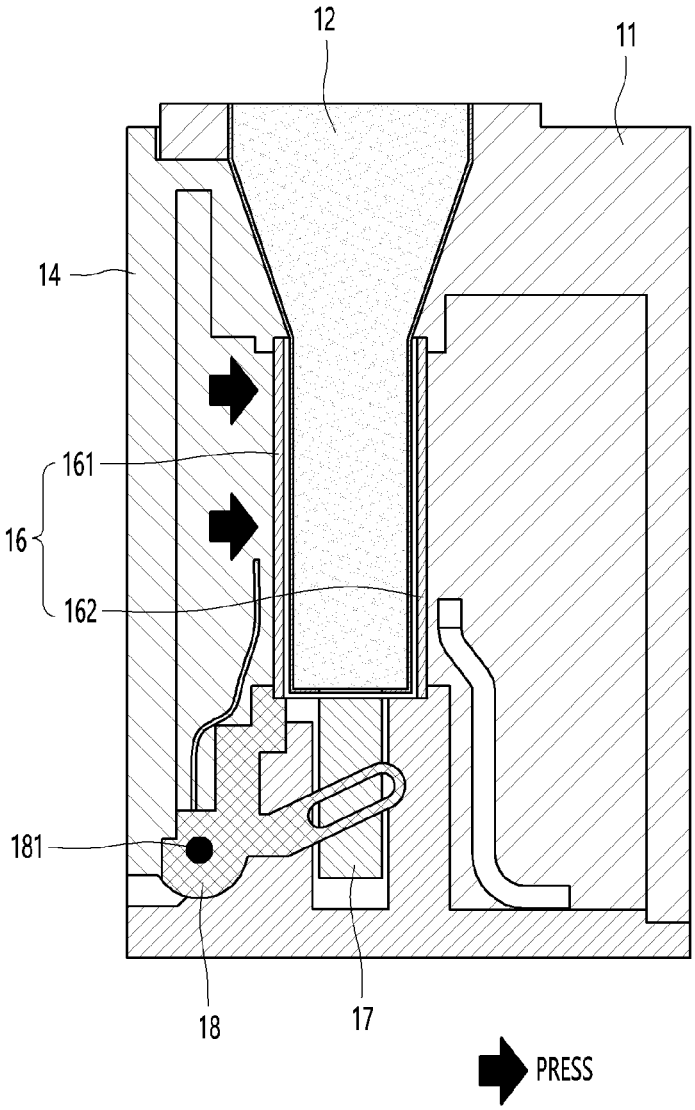

[FIG. 4]
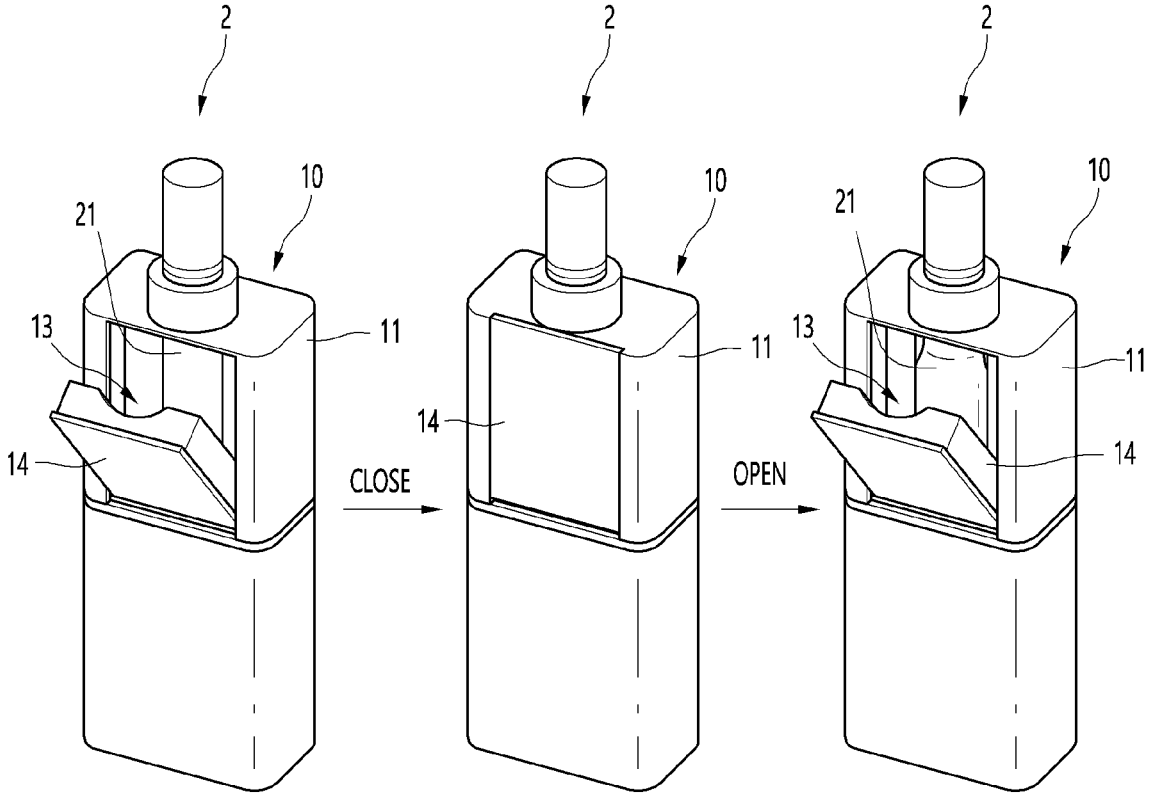

[FIG. 5]
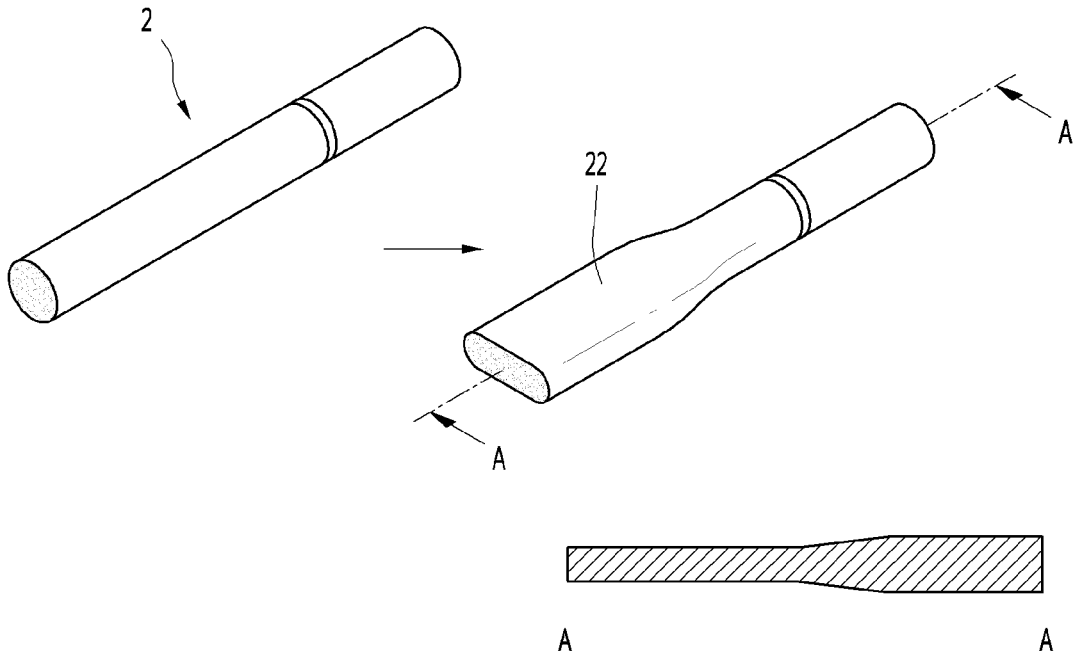
[FIG. 6]
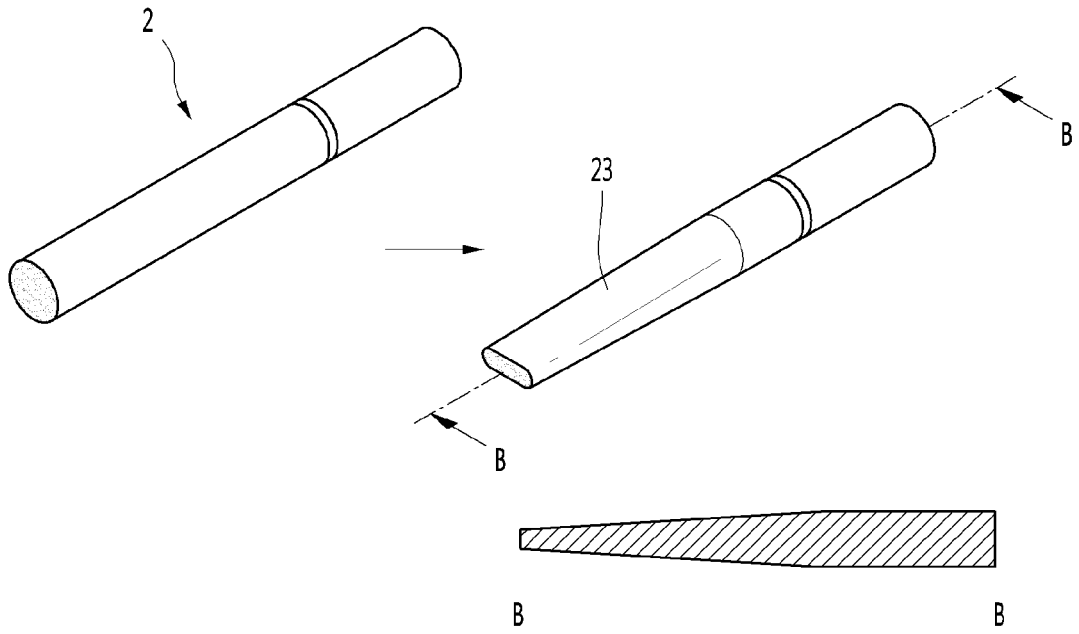

[FIG. 7]
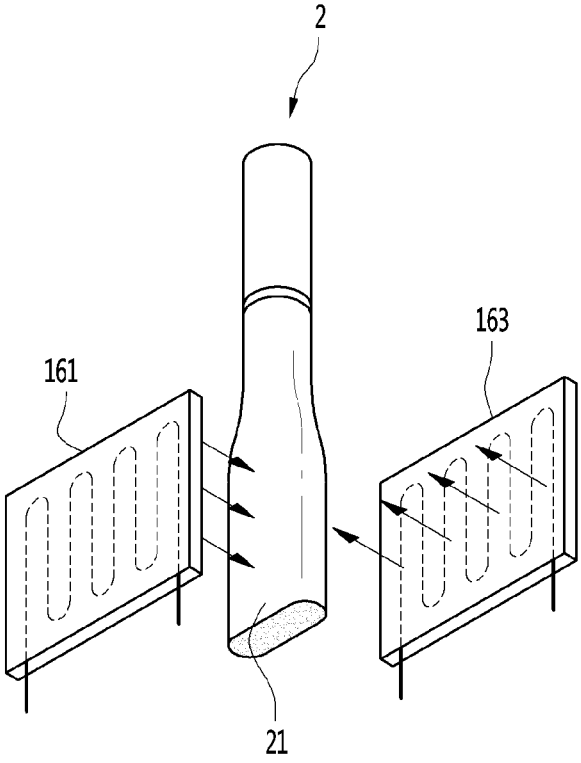

[FIG. 8]
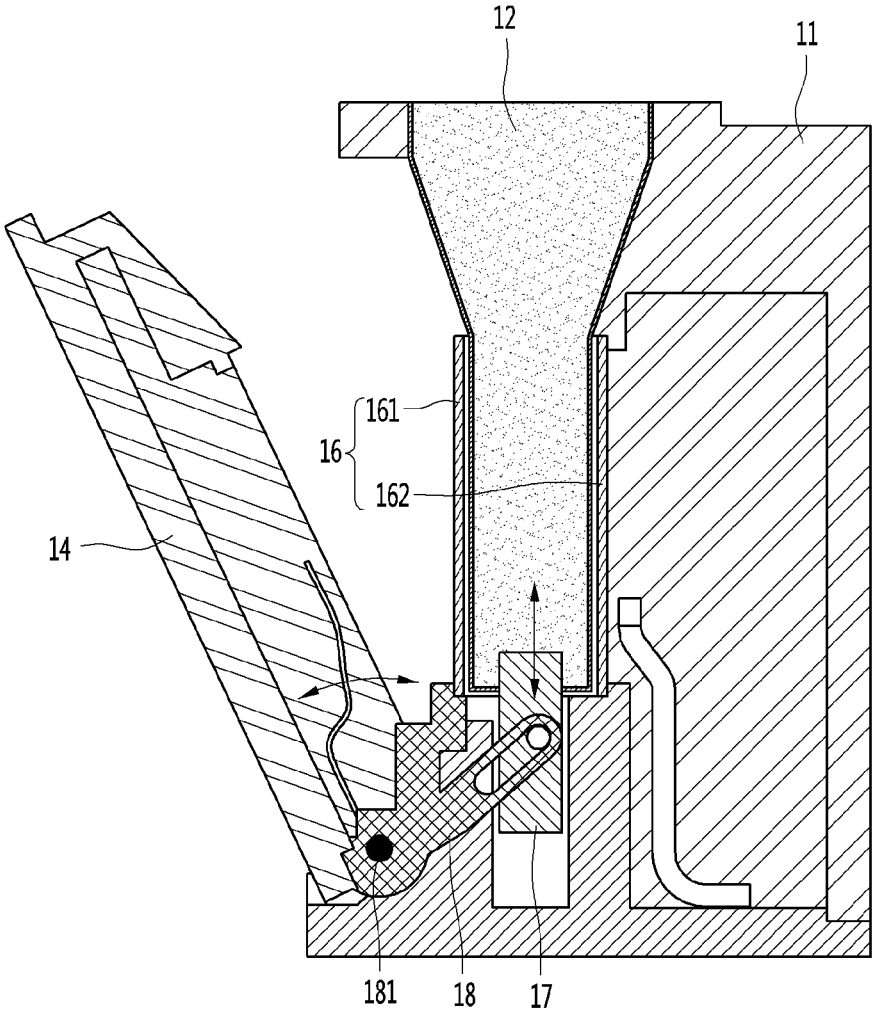

[FIG. 9]
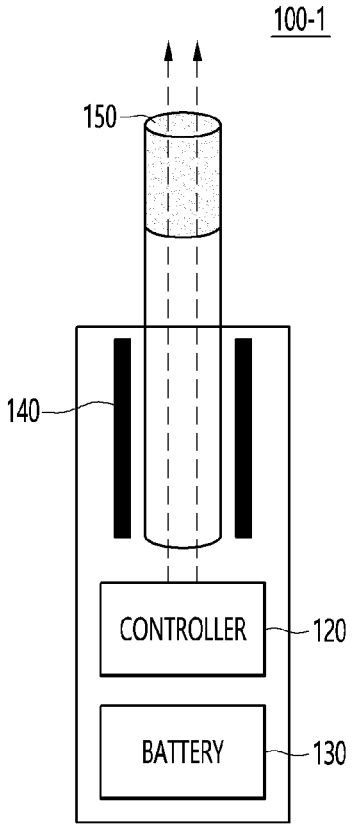

[FIG. 10]
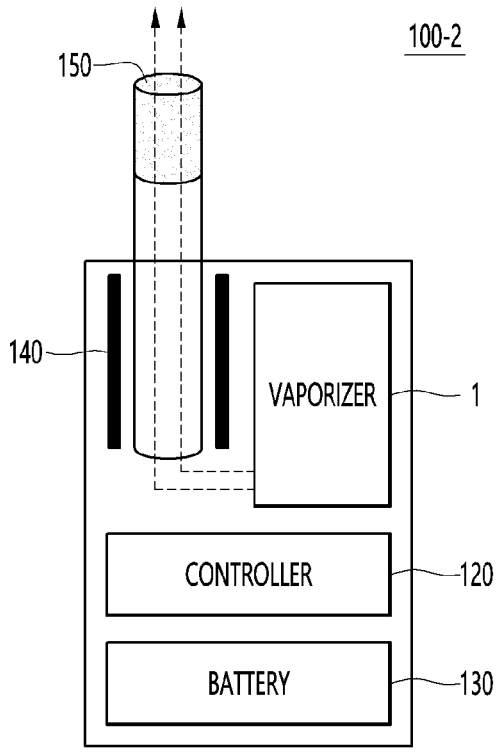

[FIG. 11]
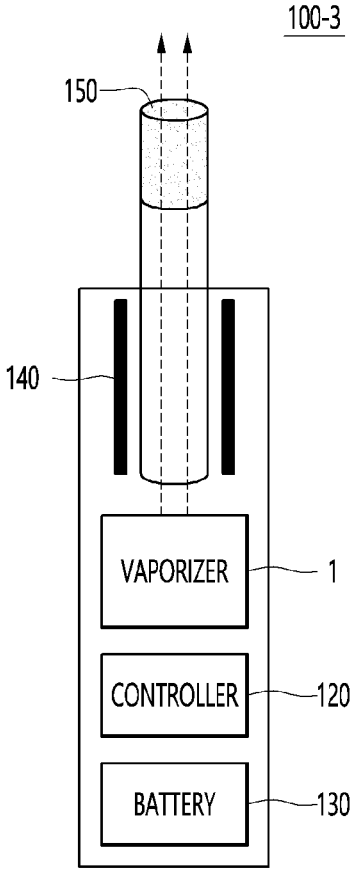

AEROSOL GENERATION DEVICE WITH REDUCED PREHEATING TIME

CROSS REFERENCE TO RELATED APPLICATIONS

This application is a National Stage of International Application No. PCT/KR2020/018746 filed Dec. 21, 2020, claiming priority based on Korean Patent Application No. 10-2020-0011902 filed Jan. 31, 2020.

TECHNICAL FIELD

The present disclosure relates to an aerosol generation device with a reduced preheating time, and more particularly, to an aerosol generation device capable of reducing a preheating time, improving an initial taste of tobacco smoke, and addressing a lack of vapor production.

BACKGROUND ART

In recent years, demand for alternative smoking articles that overcome disadvantages of traditional cigarettes has increased. For example, demand for aerosol generation devices that electrically heat cigarettes to generate an aerosol has increased, and accordingly, active research has been carried out on electric heating-type aerosol generation devices.

General electric heating-type aerosol generation devices employ a structure in which a heater disposed around a cigarette heats an outer portion of a medium of the cigarette. However, in such a structure, since a considerable amount of time is taken to evenly heat the outer portion through a central portion of the medium , a preheating time of the device is inevitably increased.

For example, FIG. 1 illustrates temperature changes for each portion of the medium of the cigarette in the above-described heating structure. As illustrated in FIG. 1, the central portion of the medium that is relatively far from the heater is heated more slowly than the outermost portion of the medium. Accordingly, a considerable amount of time (e.g., T1) is taken to evenly heat the entire medium, which indicates that the preheating time of the device is increased.

As a result, in the electric heating-type aerosol generation device that employs the above-described heating structure, the preheating time is inevitably increased due to the characteristics of the heating structure, and this may lead to consumer complaints.

DISCLOSURE

Technical Problem

Some embodiments of the present disclosure are directed to providing an aerosol generation device in which an initial preheating time is reduced.

Some embodiments of the present disclosure are also directed to providing an aerosol generation device in which an initial taste of tobacco smoke is improved and a lack of vapor production is addressed.

Some embodiments of the present disclosure are also directed to providing an aerosol generation device that has a function allowing easy removal of an aerosol-generating article.

Objectives of the present disclosure are not limited to the above-mentioned objectives, and other unmentioned objectives should be clearly understood by those of ordinary skill in the art to which the present disclosure pertains from the description below.

Technical Solution

An aerosol generation device according to some embodiments of the present disclosure includes a case including an opening formed in one surface, and an article insertion portion into which an aerosol-generating article including an aerosol-generating substrate is to be inserted, an opening/closing type cover which is disposed on the one surface of the case to open and close the opening and which is configured to, when closing the opening, mechanically press an aerosol-generating substrate portion of the inserted aerosol-generating article, and a heater configured to heat the inserted aerosol-generating article.

In some embodiments, the heater may include a first heater configured to heat one surface of the pressed aerosol-generating substrate portion and a second heater configured to heat the opposite surface to the one surface.

In some embodiments, the aerosol generation device may further include an extractor configured to push the inserted aerosol-generating article in a direction opposite to an insertion direction of the aerosol-generating article.

In some embodiments, the extractor may be operated to lift the inserted aerosol-generating article as the opening/closing type cover is opened. For example, the opening/closing type cover may open the opening by rotary motion, the opening/closing type cover may be mechanically interlocked with the extractor by an interlocking member that converts the rotary motion to linear motion, such that the extractor mechanically lifts the inserted aerosol-generating article by the linear motion.

In some embodiments, the pressed aerosol-generating substrate portion may have a flat shape or an inclined shape.

An aerosol generation device according to some other embodiments of the present disclosure includes a case including an opening formed in one surface, and an article insertion portion into which an aerosol-generating article including an aerosol-generating substrate is to be inserted, an opening/closing type cover which is disposed on the one surface of the case to open and close the opening, an extractor configured to push the inserted aerosol-generating article in a direction opposite to an insertion direction of the inserted aerosol-generating article as the opening/closing type cover opens the opening, and a heater configured to heat the inserted aerosol-generating article.

In some embodiments, the opening/closing type cover may be configured to, when closing the opening, mechanically press an aerosol-generating substrate portion of the insertedaerosol-generating article.

Advantageous Effects

According to various embodiments of the present disclosure, since an aerosol-generating substrate portion is pressed, temperature differences between portions of the aerosol-generating substrate can be minimized, and the aerosol-generating substrate can be rapidly heated to a target temperature. Accordingly, a preheating time of an aerosol generation device can be reduced, an initial taste of tobacco smoke can be improved, and a lack of vapor production can be addressed.

Also, since a heater structure that heats the pressed aerosol-generating substrate portion from both sides is employed, the preheating time of the aerosol generation device can be further reduced.

In addition, since an extractor mechanically interlocked to an opening/closing type cover is operated to push an aerosol-generating article when the cover is opened, the inserted aerosol-generating article can be easily removed.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is a view for describing a problem in which a preheating time increases in an electric heating-type aerosol generation device having an external heating structure.

FIG. 2 is an exemplary perspective view illustrating an aerosol generation device according to some embodiments of the present disclosure.

FIG. 3 illustrates an internal structure of the aerosol generation device according to some embodiments of the present disclosure.

FIG. 4 illustrates the pressing of an aerosol-generating article by an opening/closing type cover according to some embodiments of the present disclosure.

FIGS. 5 and 6 illustrate shapes of the aerosol-generating article pressed by the opening/closing type cover according to some embodiments of the present disclosure.

FIG. 7 illustrates a heating structure of a heater according to some embodiments of the present disclosure.

FIG. 8 illustrates an interlocking structure of the opening/closing type cover and an extractor according to some embodiments of the present disclosure.

FIGS. 9 to 11 are exemplary block diagrams illustrating aerosol generation devices according to various embodiments of the present disclosure.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various other forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the presence of or the possibility of adding one or more components, steps, operations, and/or devices other than those mentioned.

Prior to the description of various embodiments of the present disclosure, some terms used herein will be clarified.

In the present specification, "aerosol-generating substrate" may refer to a material that is able to generate an aerosol. The aerosol may include a volatile compound. The aerosol-generating substrate may be a solid or liquid.

For example, solid aerosol-generating substrates may include solid materials based on tobacco raw materials such as reconstituted tobacco leaves, shredded tobacco, and reconstituted tobacco, and aerosol-generating substrates in a liquid state may include liquid compositions based on nicotine, tobacco extracts, and/or various flavoring agents. However, the scope of the present disclosure is not limited to the above-listed examples.

As a more specific example, the aerosol-generating substrates in a liquid state may include at least one of propylene glycol (PG) and glycerin (GLY) and may further include at least one of ethylene glycol, dipropylene glycol, diethylene glycol, triethylene glycol, tetraethylene glycol, and oleyl alcohol. As another example, the aerosol-generating substrate may further include at least one of nicotine, moisture, and a flavoring material. As still another example, the aerosol-generating substrate may further include various additives such as cinnamon and capsaicin. The aerosol-generating substrate may include not only a liquid material with high fluidity but also a material in the form of gel or a solid. In this way, as the components constituting the aerosol-generating substrate, various materials may be selected according to embodiments, and composition ratios thereof may also vary according to embodiments. In the following description, "liquid" may be understood as referring to the aerosol-generating substrate in a liquid state.

In the specification, "aerosol generation device" may refer to a device that generates an aerosol using an aerosol-generating substrate in order to generate an aerosol that can be inhaled directly into the user's lungs through the user's mouth. Examples of the aerosol generation device may include a liquid-type aerosol generation device using a liquid vaporizer and a hybrid-type aerosol generation device using a liquid vaporizer and a cigarette together. However, the examples of the aerosol generation device may further include various other kinds of aerosol generation devices, and the scope of the present disclosure is not limited to the above-listed examples. Some examples of the aerosol generation device will be described below with reference to FIGS. 9 to 11.

In the specification, "aerosol-generating article" may refer to an article capable of generating an aerosol. The aerosol-generating article may include an aerosol-generating substrate. An example of the aerosol-generating article may include a cigarette, but the scope of the present disclosure is not limited to this example.

In the specification, "puff" refers to inhalation by a user, and the inhalation may refer to a user's act of drawing in smoke into his or her oral cavity, nasal cavity, or lungs through the mouth or nose.

In the specification, "upstream" or "upstream direction" may refer to a direction moving away from an oral region of a smoker, and "downstream" or "downstream direction" may refer to a direction approaching the oral region of the smoker.

Hereinafter, various embodiments of the present disclosure will be described in detail with reference to the accompanying drawings.

FIG. 2 is an exemplary perspective view illustrating an aerosol generation device 10 according to some embodiments of the present disclosure, and FIG. 3 illustrates an internal structure of the aerosol generation device 10. In particular, FIG. 3 illustrates an internal structure of an upper case 11. Hereinafter, description will be given with reference to FIGS. 2 and 3.

As illustrated in FIGS. 2 and 3, the aerosol generation device 10 according to an embodiment may include the upper case 11, which includes an article insertion portion 12 into which an aerosol-generating article 2 is inserted, an opening/closing type cover 14, and a lower case 15. Also, the aerosol generation device 10 may further include a heater 16 and an extractor 17. However, only the components relating to the embodiment of the present disclosure are illustrated in FIGS. 2 and 3. Therefore, those of ordinary skill in the art to which the present disclosure pertains should understand that the aerosol generation device 10 may further include general-purpose components other than the components illustrated in FIGS. 2 and 3. For example, although not illustrated, the aerosol generation device 10 may further include a battery (not illustrated) and a controller (not illustrated), and the components may be disposed inside the lower case 15.

Also, not all the components mentioned above may be essential components of the aerosol generation device 10, and the aerosol generation device 10 may also be implemented in the form in which some of the above components are omitted. For example, an aerosol generation device 10 according to some other embodiments may be configured without the extractor 17. Hereinafter, each component of the aerosol generation device 10 will be described.

The upper case 11 may form an upper exterior of the aerosol generation device 10. Also, the article insertion portion 12 into which the aerosol-generating article 2 is inserted may be formed in the upper case 11, and an opening 13 may be formed in one surface (e.g., front surface) of the upper case 11. The opening 13 may be opened or closed by the opening/closing type cover 14 which will be described below. Hereinafter, for convenience of description, the opening/closing type cover 14 will be referred to as "cover 14" in short.

The article insertion portion 12 may form an insertion region into which the aerosol-generating article 2 is inserted. The insertion region may be formed in a shape that corresponds to the shape of the aerosol-generating article 2. For example, in a case in which the aerosol-generating article 2 has a cylindrical shape, the article insertion portion 12 may also form a cylindrical insertion region. Also, the article insertion portion 12 may be formed at an appropriate depth that allows at least a portion (e.g., aerosol-generating substrate portion 21) of the aerosol-generating article 2 to be heated by the heater 16 disposed inside the aerosol generation device 10.

The aerosol-generating article 2 may include the aerosol-generating substrate portion 21, and the aerosol-generating substrate portion 21 may be disposed on the upstream side of the aerosol-generating article 2. The aerosol-generating substrate portion 21 may be inserted into the aerosol generation device 10 through the article insertion portion 12 and may be heated by the heater 16, which is disposed inside the aerosol generation device 10, to generate an aerosol. The generated aerosol may be inhaled by a user through the oral region of the user.

The aerosol-generating article 2 may have a cylindrical shape, but the scope of the present disclosure is not limited thereto. However, for convenience of understanding, description will be given assuming that the aerosol-generating article 2 has a cylindrical shape.

Next, the cover 14 may open and close the opening 13. Various methods may be used to implement the opening/closing function. For example, the cover 14 may be implemented to have a mechanical structure that allows opening/closing to be performed manually. As a more specific example, the cover 14 may be implemented to allow manual opening/closing using a hinge, a magnet, a spring, and the like. However, the method of implementing the cover 14 is not limited thereto.

FIG. 3 illustrates the cover 14 coupled to a hinge member 181. The illustrated cover 14 may use the hinge member 181 as the axis of rotation to provide the opening/closing function. Also, the cover 14 may be interlocked with the extractor 17 through the hinge member 181 and an interlocking member 18. This will be described below with reference to FIG. 8.

In some embodiments, the cover 14 may be controlled by the controller (not illustrated), and when insertion of the aerosol-generating article 2 is detected by a sensor, in response to the detection, the cover 14 may be operated to close the opening 13. Also, when a termination of smoking of the aerosol-generating article 2 is detected or a specific user input is detected by the sensor, in response to the detection, the cover 14 may be operated to open the opening 13.

Also, in some embodiments, the cover 14 may be configured to, when closing the opening 13, press the inserted aerosol-generating article 2. More specifically, as illustrated in FIG. 3, the cover 14 may be configured to, during the closing operation, press the aerosol-generating substrate portion 21 that is to be heated by the heater 16. In this way, a central portion of the aerosol-generating substrate portion 21 may become closer to the heater 16, and differences between distances from the heater 16 to different portions (e.g., central portion, outer portion) of the aerosol-generating substrate portion 21 may be minimized. Also, accordingly, since the entire aerosol-generating substrate portion 21 may be rapidly heated to a target temperature, a preheating time of the aerosol generation device 10 may be significantly reduced, an initial taste of tobacco smoke may be improved, and the amount of vapor production may be increased. To provide further convenience of understanding, the present embodiment will be further described with reference to FIGS. 4 to 6.

FIG. 4 illustrates the pressing of the aerosol-generating article 2 according to the closing operation of the cover 14.

As illustrated in FIG. 4, as the cover 14 closes the opening 13 and is fastened to the upper case 11, the aerosol-generating substrate portion 21 may be mechanically pressed by the cover 14. The aerosol-generating substrate portion 21 in a pressed state that is visible when the opening 13 is opened by the cover 14 again is illustrated on the rightmost side of FIG. 4.

Meanwhile, the degree to which the cover 14 presses the aerosol-generating substrate portion 21 may vary according to the embodiment, but it may be important that the aerosol-generating substrate portion 21 is pressed with an appropriate strength. This is because, when the cover 14 presses the aerosol-generating substrate portion 21 too weakly, the preheating time reducing effect may be decreased, and when the cover 14 presses the aerosol-generating substrate portion 21 too strongly, the cigarette paper may rupture and the solid aerosol-generating substrate may spill out, the cover 14 may not be closed well, or the resistance to draw of the aerosol-generating article 2 may become too high.

In some embodiments, the cover 14 may press the aerosol-generating substrate portion 21 so that a diameter thereof is within a range of 10% to 50% of a diameter of the aerosol-generating article 2. For example, in a case in which the diameter of the aerosol-generating article 2 is 7.2 mm, the aerosol-generating substrate portion 21 may be pressed so that a diameter thereof is in a range of 3.6 mm to 6.5 mm. Preferably, the aerosol-generating substrate portion 21 may be pressed so that the diameter of the aerosol-generating substrate portion 21 is in a range of 15% to 45%, 20% to 45%, 15% to 40%, or 20% to 40% of the diameter of the aerosol-generating article 2. Within these numerical ranges, the phenomenon in which the cigarette paper ruptures may be reduced, and the preheating time may be significantly reduced.

Also, the shape in which the aerosol-generating substrate portion 21 is pressed may vary according to the embodiment.

In some embodiments, an aerosol-generating substrate portion 22 may be pressed to have a flat shape as a whole. Alternatively, as illustrated in FIG. 5, the aerosol-generating substrate portion 22 may be pressed so that an upstream portion thereof has a flat shape and a downstream portion thereof has a gently inclined shape. In such a case, since the entire aerosol-generating substrate portion 22 may be rapidly heated, the preheating time reducing effect may be maximized.

In some other embodiments, as illustrated in FIG. 6, an aerosol-generating substrate portion 23 may be pressed to have an inclined shape as a whole. In such a case, the problem in which cigarette paper ruptures may be alleviated. Also, since the rupture of the cigarette paper is alleviated, the aerosol-generating substrate portion 23 may be pressed more strongly, and the preheating time reducing effect may be further improved.

The description of the components of the aerosol generation device 10 will be continued by referring back to FIGS. 2 and 3.

The heater 16 may be disposed inside the upper case 11 to heat the aerosol-generating article 2 inserted through the article insertion portion 12. More specifically, the heater 16 may heat the aerosol-generating substrate portion 21 of the inserted aerosol-generating article 2 to generate an aerosol. The heater 16 may be implemented as an electric resistive heater, but the scope of the present disclosure is not limited thereto.

In some embodiments, as illustrated in FIG. 7, the heater 16 may include a first heater 161 configured to heat one surface of the pressed aerosol-generating substrate portion 21 and a second heater 162 configured to heat the opposite surface of the aerosol-generating substrate portion 21. The first heater 161 and the second heater 162 may heat the pressed aerosol-generating substrate portion 21 from both sides so that the entire aerosol-generating substrate portion 21 rapidly reaches a target temperature. Accordingly, the preheating time of the aerosol generation device 10 may be reduced, and an initial taste of tobacco smoke and vapor production of the aerosol-generating article 2 may be improved.

In the above-described embodiment, the first heater 161 and the second heater 162 may have a flat shape as illustrated in FIG. 7 or may have a curved shape to surround the aerosol-generating substrate portion 21. However, the scope of the present disclosure is not limited to such examples, and the shape of the first heater 161 and the second heater 162 may be designed and modified in various ways on the basis of the shape in which the aerosol-generating substrate portion 21 is pressed.

Description will be given by referring to FIGS. 2 and 3 again.

Next, the extractor 17 may be disposed around an upstream end portion of the aerosol-generating article 2 inserted through the article insertion portion 12 and may be operated to push the inserted aerosol-generating article 2 in the opposite direction of an insertion direction (that is, direction of removal/withdrawal). Due to the operation of the extractor 17, the aerosol-generating article 2 may be easily and neatly removed from the aerosol generation device 10.

In some embodiments, as illustrated in FIG. 8, the extractor 17 may be mechanically interlocked with the cover 14 by the interlocking member 18. The interlocking member 18 may include the hinge member 181 that acts as the axis of rotation of the cover 14, and the rotary motion of the cover 14 may be converted to linear reciprocating motion by the interlocking member 18. That is, the extractor 17 may be implemented to reciprocate in a longitudinal direction of the inserted aerosol-generating article 2 when the cover 14 rotates. Accordingly, the opening operation (i.e., rotary motion) of the cover 14 and the extracting operation (i.e., linear motion) of the extractor 17 may be linked, and thus the aerosol-generating article 2 may be easily removed, thereby significantly improving user convenience.

In some other embodiments, the extractor 17 may also be implemented to be electrically operated. For example, the extractor 17 may be controlled by the controller (not illustrated) and may be implemented to push the aerosol-generating article 2 in response to the opening operation of the cover 14 or a user input requesting the removal of the aerosol-generating article 2.

Meanwhile, although not illustrated in FIGS. 2 and 3, the aerosol generation device 10 may further include the controller (not illustrated) and the battery (not illustrated).

The battery may supply necessary power to the controller or to other components (e.g., the heater 16) of the aerosol generation device 10.

Next, the controller may control the overall operation of the aerosol generation device 10. For example, the controller may control a heating temperature of the heater 16 on the basis of a target temperature. The target temperature may be determined on the basis of a temperature profile of the aerosol-generating article 2.

In some embodiments, the controller may independently control the first heater 161 and the second heater 162. For example, the controller may control the heating temperatures of the first heater 161 and the second heater 162 on the basis of the same target temperature. As another example, the controller may control the heating temperatures of the first heater 161 and the second heater 162 on the basis of different target temperatures. As a more specific example, in a case in which a distance from the central portion of the aerosol-generating substrate to the first heater 161 and a distance from the central portion of the aerosol-generating substrate to the second heater 162 are different (e.g., the aerosol-generating substrate portion 21 is pressed to have an asymmetrical structure), the controller may control one of the heaters 161 and 162 which is disposed farther from the central portion than the other on the basis of a higher target temperature.

In the above-described embodiment, the controller may control each of the heaters 161 and 162 on the basis of a pulse width modulation (PWM) method, but the control method is not limited thereto.

Meanwhile, in a case in which each of the heaters 161 and 162 is controlled using the PWM method, on-duty sections of the heaters 161 and 162 (on-duty sections of PWM control signals of the heaters) may overlap in some cases. For example, in a case in which the heaters 161 and 162 are controlled on the basis of different target temperatures, as the duty ratio or duty cycle of each of the heaters 161 and 162 changes, the on-duty sections may overlap or the sum of the duty ratios may exceed a threshold value (e.g., 100%). In such a case, an overcurrent may flow instantaneously and adversely affect the battery. In order to prevent such a problem, in a case in which the sum of the duty ratios of the heaters 161 and 162 is less than the threshold value and the on-duty sections overlap, the controller may adjust phases of the on-duty sections of the heaters 161 and 162 so that the on-duty sections do not overlap. Also, in a case in which the sum of the duty ratios exceeds the threshold value, the controller may decrease the duty ratios of the specific heaters 161 and 162. Here, as the duty ratios are decreased, the power supplied to the specific heaters 161 and 162 may be reduced, and in order to compensate therefor, the controller may use a step-up DC-DC converter to additionally supply as much power as the reduced power to the specific heaters 161 and 162.

The aerosol generation device 10 according to some embodiments of the present disclosure has been described above with reference to FIGS. 1 to 8. According to the above description, when the cover 14 is closed, the aerosol-generating substrate portion 21 may be pressed, and thus temperature differences between portions of the aerosol-generating substrate may be minimized, and the aerosol-generating substrate may be rapidly heated to a target temperature. Accordingly, the preheating time of the aerosol generation device 10 may be reduced, an initial taste of tobacco smoke may be improved, and an amount of vapor production may be increased. Also, since the heater structure that heats the pressed aerosol-generating substrate portion 21 from both sides is employed, the preheating time of the aerosol generation device 10 may be further reduced. Also, when the cover is opened, the extractor 17 mechanically interlocked with the cover 14 may be operated to lift the aerosol-generating article 2, and thus the inserted aerosol-generating article 2 may be easily removed.

Hereinafter, various types of aerosol generation devices 100-1 to 100-3 to which various embodiments of the present disclosure described above may be applied will be described with reference to FIGS. 9 to 11.

FIGS. 9 to 11 are exemplary block diagrams illustrating the aerosol generation devices 100-1 to 100-3. A heater 140 may correspond to the heater 16 illustrated in FIG. 2.

FIG. 9 illustrates a cigarette-type aerosol generation device 100-1, and FIGS. 10 and 11 illustrate hybrid-type aerosol generation devices 100-2 and 100-3 that use a liquid and a cigarette together. Hereinafter, each of the aerosol generation devices 100-1 to 100-3 will be described.

As illustrated in FIG. 9, the aerosol generation device 100-1 may include the heater 140, a battery 130, and a controller 120. However, this is merely a preferred embodiment for achieving the objectives of the present disclosure, and of course, some components may be added or omitted as necessary. Also, the components of the aerosol generation device 100-1 illustrated in FIG. 9 represent functional components that are functionally distinct, and the plurality of components may be implemented to be integrated with each other in an actual physical environment, or a single component may be implemented to be divided into a plurality of specific functional components. Hereinafter, each component of the aerosol generation device 100-1 will be described.

The heater 140 may be disposed around a cigarette 150 to heat the cigarette 150. The cigarette 150 may include a solid aerosol-generating substrate and may generate an aerosol when heated. The generated aerosol may be inhaled by a user through the oral region of the user. For example, the heater 140 may be an electric resistive heater but is not limited thereto. The heater 140 or a heating temperature of the heater 140 may be controlled by the controller 120.

As described above, the heater 140 may have a structure that heats the pressed cigarette 150 from both sides, and in this way, a preheating time of the aerosol generation device 100-1 may be significantly reduced.

Next, the battery 130 may supply the power used to operate the aerosol generation device 100-1. For example, the battery 130 may supply power to allow the heater 140 to heat the aerosol-generating substrate included in the cigarette 150 and may supply power required for the controller 120 to operate.

Also, the battery 130 may supply power required to operate electrical components such as a display (not illustrated), a sensor (not illustrated), and a motor (not illustrated) which are installed in the aerosol generation device 100-1.

Next, the controller 120 may control the overall operation of the aerosol generation device 100-1. For example, the controller 120 may control the operation of the heater 140 and the battery 130 and also control the operation of other components included in the aerosol generation device 100-1. The controller 120 may control the power supplied by the battery 130, the heating temperature of the heater 140, and the like. Also, the controller 120 may check a state of each component of the aerosol generation device 100-1 and determine whether the aerosol generation device 100-1 is in an operable state.

The controller 120 may be implemented by at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should understand that the controller 120 may also be implemented with other forms of hardware.

Hereinafter, the hybrid-type aerosol generation devices 100-2 and 100-3 will be briefly described with reference to FIGS. 10 and 11.

FIG. 10 illustrates the aerosol generation device 100-2 in which a vaporizer 1 and a cigarette 150 are arranged in parallel, and FIG. 11 illustrates the aerosol generation device 100-3 in which the vaporizer 1 and the cigarette 150 are arranged in series. However, the inner structures of the aerosol generation devices are not limited to those illustrated in FIGS. 10 and 11, and the arrangement of the components may be changed according to design methods.

In FIGS. 10 and 11, the vaporizer 1 may include a liquid reservoir configured to store an aerosol-generating substrate in a liquid state, a wick configured to absorb the aerosol-generating substrate, and a heating element configured to heat the absorbed aerosol-generating substrate to generate an aerosol. The aerosol generated in the vaporizer 1 may pass through the cigarette 150 and be inhaled by a user through the oral region of the user. The heating element of the vaporizer 1 may also be controlled by the controller 120.

The exemplary aerosol generation devices 100-1 to 100-3 have been described above with reference to FIGS. 9 to 11.

All the components constituting the embodiments of the present disclosure have been described above as being combined into one body or being operated in combination, but the technical idea of the present disclosure is not necessarily limited to the embodiments. That is, any one or more of the components may be selectively operated in combination within the intended scope of the present disclosure.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. An aerosol generation device comprising:

a case including an opening formed in one surface, and an article insertion portion into which an aerosol-generating article including an aerosol-generating substrate is to be inserted;

an opening/closing type cover disposed on the one surface of the case to open and close the opening, and configured to, when closing the opening, mechanically press an aerosol-generating substrate portion of the inserted aerosol-generating article; and a heater configured to heat the inserted aerosol-generating article, wherein the pressed aerosol-generating substrate portion comprises an upstream portion having a flat shape and a downstream portion having an inclined shape, wherein the heater includes a first heater configured to heat one surface of the pressed aerosol-generating substrate portion and a second heater configured to heat the opposite surface of the one surface, and wherein the opening/closing type cover is configured to, when closing the opening, mechanically press the aerosol-generating substrate portion of the inserted aerosol-generating article in a radius direction, the radius direction intersecting an axis in an insertion direction of the article insertion portion, so as to shorten the distance between a surface of the first heater where the one surface of the aerosol-generating substrate portion is heated and a surface of the second heater where the opposite side of the aerosol-generating substrate portion is heated.

2. The aerosol generation device of claim 1, further comprising a controller configured to control the heater, wherein the controller independently controls the first heater and the second heater.

3. The aerosol generation device of claim 1, further comprising an extractor configured to push the inserted aerosol-generating article in a direction opposite to an insertion direction of the inserted aerosol-generating article.

4. The aerosol generation device of claim 3, wherein the extractor is interlocked with the opening/closing type cover such that the extractor pushes the inserted aerosol-generating article as the opening/closing type cover opens the opening.

5. The aerosol generation device of claim 4, wherein:

the opening/closing type cover opens the opening by rotary motion;

the opening/closing type cover is mechanically interlocked with the extractor by an interlocking member configured to convert the rotary motion of the opening/closing type cover to linear motion of the extractor; and the extractor is configured to mechanically push the inserted aerosol-generating article by the linear motion.

6. The aerosol generation device of claim 1, wherein:

the aerosol-generating article has a cylindrical shape; and the opening/closing type cover presses the aerosol-generating substrate portion to have a diameter within a range of 10% to 50% of a diameter of the aerosol-generating article.

* * * * *